US008006353B2

(12) United States Patent
Reynolds

(10) Patent No.: US 8,006,353 B2
(45) Date of Patent: Aug. 30, 2011

(54) RETAINER FOR BAG SHOULDER STRAP

(76) Inventor: Patricia E. Reynolds, Chicago, IL (US)

( * ) Notice: Subject to any disclaimer, the term of this patent is extended or adjusted under 35 U.S.C. 154(b) by 812 days.

(21) Appl. No.: 12/082,124

(22) Filed: Apr. 9, 2008

(65) Prior Publication Data

US 2009/0255094 A1 Oct. 15, 2009

(51) Int. Cl.
*A45F 5/00* (2006.01)

(52) U.S. Cl. ..... 24/3.13; 24/3.1; 24/707.7; 24/363; 224/182

(58) Field of Classification Search ..... 24/3.12, 24/360, 363, 370, 706.2, 707.7, 709.2; 16/4, 16/6, 8; 224/182, 264
See application file for complete search history.

(56) References Cited

U.S. PATENT DOCUMENTS

| | | | | | |
|---|---|---|---|---|---|
| 326,717 | A | * | 9/1885 | Chapman | 24/707.7 |
| 451,829 | A | * | 5/1891 | Lucas | 24/707.7 |
| 754,743 | A | * | 3/1904 | Buckelew | 24/707.7 |
| 788,592 | A | * | 5/1905 | Norene | 24/707.7 |
| 895,979 | A | * | 8/1908 | Deiner | 24/707.7 |
| 896,214 | A | * | 8/1908 | King | 24/707.7 |
| 1,027,527 | A | | 5/1912 | Davis | |
| 1,438,889 | A | * | 12/1922 | Bates et al. | 24/707.7 |
| 1,586,916 | A | * | 6/1926 | Pilkington | 24/707.7 |
| 2,113,786 | A | | 4/1938 | Garfinkel | |
| 2,508,219 | A | * | 5/1950 | Budlong | 24/707.7 |
| 4,386,723 | A | | 6/1983 | Mule | |
| 4,879,768 | A | | 11/1989 | McClees et al. | |
| 4,887,318 | A | | 12/1989 | Weinreb | |
| 5,016,368 | A | | 5/1991 | Cassata | |
| 5,441,188 | A | | 8/1995 | Rosenstein | |

* cited by examiner

*Primary Examiner* — Robert J Sandy
(74) *Attorney, Agent, or Firm* — Wood, Phillips, Katz, Clark & Mortimer

(57) ABSTRACT

A retainer for a bag shoulder strap, including a flat longitudinal member having a retaining portion on one end, a pin retaining member secured to one side of the flat longitudinal member, and a pin member. The pin retaining member defines a transverse space between the retaining member and the longitudinal member adjacent the longitudinal member other end, and also includes wings spaced from the longitudinal member and projecting inwardly from opposite sides adjacent the longitudinal member one end. The pin member includes a transverse portion pivotally trapped in the transverse space, and first and second pin legs extending longitudinally from opposite ends of the transverse portion to pointed ends adjacent the longitudinal member one end. In a securing position the pointed ends of the pin legs are between the pin retaining member wings and the longitudinal member.

20 Claims, 3 Drawing Sheets

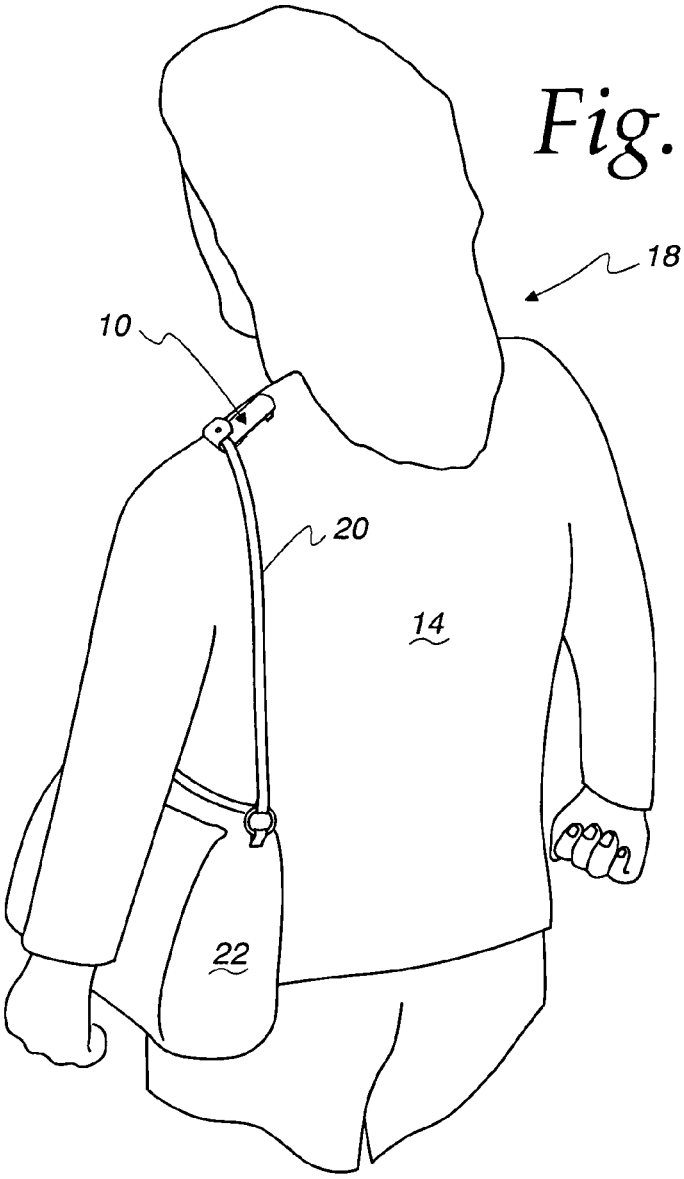
Fig. 1
Fig. 2
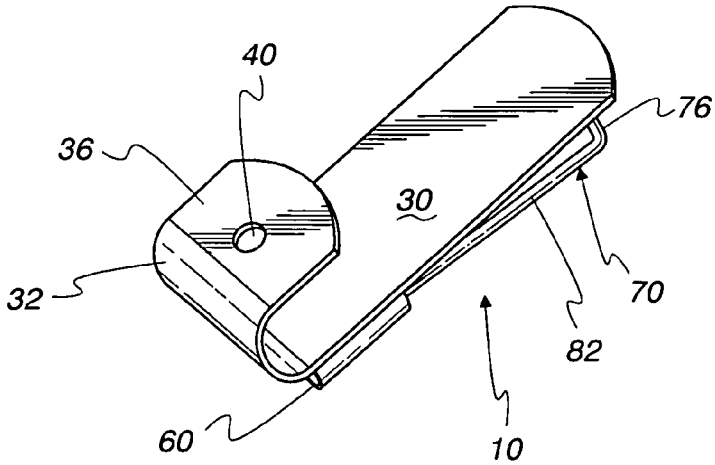

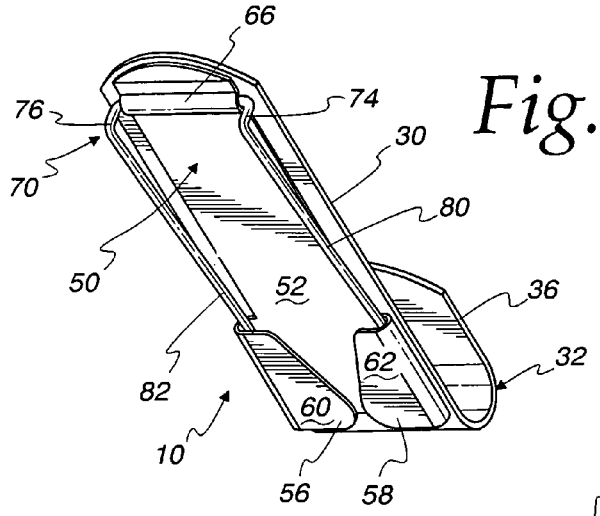
Fig. 3
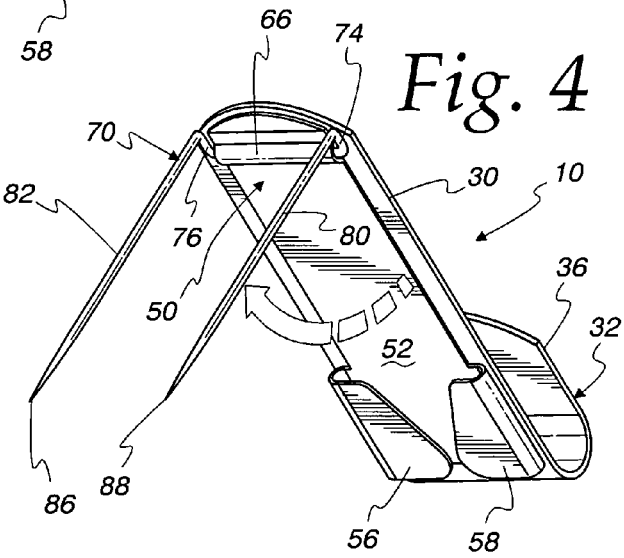
Fig. 4
Fig. 5
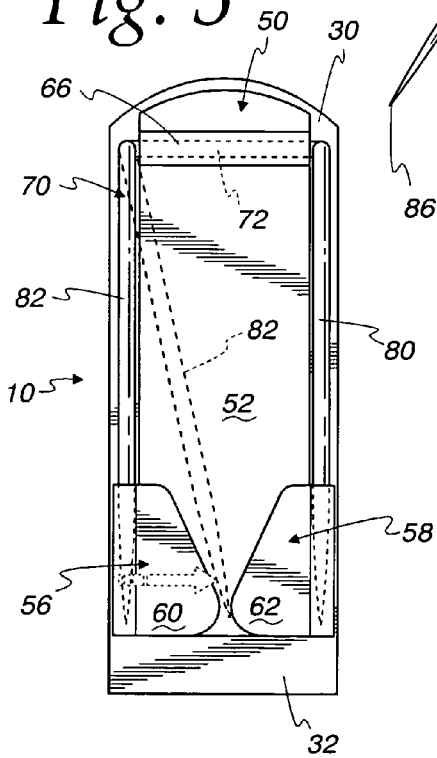

RETAINER FOR BAG SHOULDER STRAP

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward strap retainers, and particularly toward retainers for shoulder straps of bags carried by individuals.

BACKGROUND OF THE INVENTION AND TECHNICAL PROBLEMS POSED BY THE PRIOR ART

More and more people in today's busy world carry more and more personal and business items with them as they move about during the day. In addition to carrying items in purses and bags, business cases are also frequently carried with computers as well as files and other items, with the purses and cases getting heavier and heavier as more items are carried. As a result, more and more of these carrying bags and cases now include shoulder straps to help the carrier support that weight. While such straps certainly help, unfortunately the downward slope of the carrier's shoulder along with the jarring which occurs while walking tends to cause the strap to slip off their shoulder. To prevent this, people are often required to use one hand to keep the strap on their shoulder, either by constantly holding the strap or by frequently reaching up with a hand to readjust the strap. This is not only irritating for the carrier, but also prevents the person from using that hand for other tasks.

In order to help support shoulder straps, a variety of structures have been suggested, including low-slip pads (U.S. Pat. Nos. 4,879,768 and 4,887,318) as well as pinned-on supports (U.S. Pat. Nos. 1,027,527, 4,386,723 and 5,411,188).

Unfortunately, whatever the design, pads still will slip off a shoulder.

The pinned-on supports tend to be difficult to put on and can be uncomfortable to use (due to small projecting components stabbing down into the user's shoulder from the weight of the carried bag). Moreover, those supports can wobble around those projecting components. That wobble not only gives a sense of instability but also creates a grinding feeling increasing the discomfort, and that movement can also potentially damage the material it is pinned onto.

The shoulder strap and jewelry retainer of U.S. Pat. No. 5,411,188 appears to have attempted to decrease the wobble by adding pin connections. That is, it uses a pair of safety pins pivotally secured to its bottom, with each safety pin pivotable around its longitudinally extending base leg. Unfortunately, while this structure may decrease wobble somewhat, it is also difficult to attach since the pins pivot independently around different axes, with manipulation of the pins always potentially hindered by the nearby retainer portion. Further, this structure also still has potentially uncomfortable projecting components. Moreover, since the pins are independent of each other, the pointed legs of the pins may be variously spaced apart from each other when inserted into a garment and then pivoted next to each other when the pins lie flat during use, further increasing the difficulty of properly locating both pins relative to each other when attaching the retainer to a garment. As a result, the pointed legs will commonly be stuck through fabric at inconsistently spaced apart positions, and even when consistently located, when the pins are closed and pivoted flat the fabric is either bunched up uncomfortably underneath the retainer portion or the fabric is stressed and possibly torn due to the different spacing of the pointed legs than the spacing when the pointed legs are stuck through the garment fabric.

The present invention is directed toward overcoming one or more of the problems set forth above.

SUMMARY OF THE INVENTION

In one aspect of the present invention, a retainer is provided for a shoulder strap of a bag. The retainer includes a flat longitudinal member having a retaining portion on one end, a pin retaining member secured to one side of the flat longitudinal member, and a pin member. The pin retaining member defines a transverse space between the retaining member and the longitudinal member adjacent the longitudinal member other end, and also includes wings spaced from the longitudinal member and projecting inwardly from opposite sides adjacent the longitudinal member one end. The pin member includes a transverse portion pivotally trapped in the transverse space, and first and second pin legs extending longitudinally from opposite ends of the transverse portion to pointed ends adjacent the longitudinal member one end. In a securing position the pointed ends of the pin legs are between the pin retaining member wings and the longitudinal member.

In one form of this aspect of the present invention, the first and second pin legs are spring bendable toward one another to a released position in which their pointed ends are not between the pin retaining member wings and the longitudinal member and the pin member transverse portion is pivotable within the transverse space.

In another form of this aspect of the present invention, arms extend radially from the ends of the pin member transverse portion and connect the first and second pin legs to the transverse portion whereby the one ends of the first and second pin legs are spaced from the longitudinal member.

In yet another form of this aspect of the present invention, the first and second pin legs are substantially parallel to one another in the securing position.

In still another form of this aspect of the present invention, the wings have flat transverse surfaces facing away from the longitudinal member and lying in substantially the same plane.

According to another form of this aspect of the present invention, the first and second pin legs have a diameter X and the wings at their closest are spaced apart less than 2X.

According to still another form of this aspect of the present invention, the retaining portion comprises a U-shape on the one end wherein one leg of the U-shape is the one end of the flat longitudinal member and the other leg of the U-shape overlies the longitudinal member one end, with the U-shaped legs being spaced apart a distance which is at least the thickness of the shoulder strap.

According to yet another form of this aspect of the present invention, the transverse space is defined by a transverse ridge adjacent the other end of the longitudinal member.

In another aspect of the present invention, a retainer is provided for a shoulder strap of a bag, including a flat longitudinal member having a U-shaped retaining portion on one end, a pin retaining member formed from a T-shaped blank having a longitudinal base with wings extending from opposite sides of one end of the base, and a pin member. One leg of the U-shape retaining portion is the one end of the flat longitudinal member and the other leg overlies and is spaced from one side of the longitudinal member one end. The wings of the retaining member are bent inwardly to project toward one another in a location spaced from the longitudinal base, and the retaining member longitudinal base is secured to the other side of the flat longitudinal member. The pin member includes a transverse portion pivotally secured to the other side of the flat longitudinal member, and first and second pin legs extending longitudinally from opposite ends of the transverse portion to pointed ends adjacent the longitudinal member one end. In a securing position the pointed ends of the pin legs are between the pin retaining member wings and the longitudinal member.

In one form of this aspect of the present invention, the pin retaining member longitudinal base includes a ridge adjacent its other end, and the ridge defines a transverse space against the longitudinal member other side in which the pin member transverse portion is pivotally trapped.

In another form of this aspect of the present invention, the retaining portion legs are spaced apart a distance which is at least the thickness of a shoulder strap.

In yet another form of this aspect of the present invention, the first and second pin legs are spring bendable toward one another to a released position in which their pointed ends are not between the pin retaining member wings and the longitudinal member.

In still another form of this aspect of the present invention, arms extend radially from the ends of the pin member transverse portion and connect the first and second pin legs to the transverse portion whereby the connected ends of the first and second pin legs are spaced from the longitudinal member.

According to another form of this aspect of the present invention, the first and second pin legs are substantially parallel to one another in the securing position.

According to still another form of this aspect of the present invention, the wings have flat transverse surfaces facing away from the longitudinal member and lying in substantially the same plane.

According to yet another form of this aspect of the present invention, the first and second pin legs have a diameter X and the wings at their closest are spaced apart less than 2X.

BRIEF DESCRIPTION OF THE DRAWINGS

FIG. 1 is a perspective view illustrating a retainer according to the present invention as used to retain a purse shoulder strap on a woman's shoulder;

FIG. 2 is a perspective view from above of a retainer according to the present invention;

FIG. 3 is a perspective view from below of the retainer of FIG. 2, with the pin member in the securing position;

FIG. 4 is a bottom perspective view similar to FIG. 3, showing the pin member in the released position;

FIG. 5 is a bottom view of the retainer of FIG. 3, illustrating in phantom the bending of one pin leg moving it clear of the retaining member wings to enable movement between the securing and retaining positions;

DETAILED DESCRIPTION OF THE INVENTION

Figure 6:
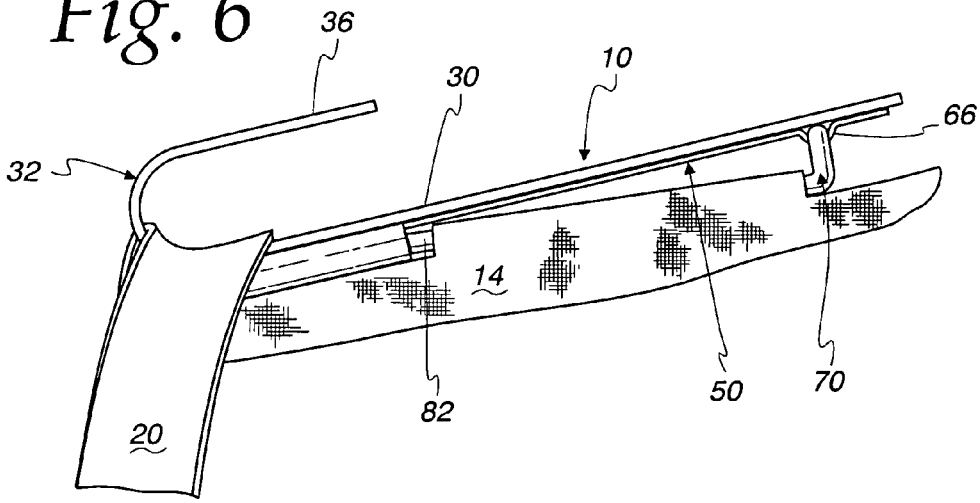
FIG. 6 is a side view of a retainer according to the present invention as attached to the shoulder of a coat of a user.

A retainer 10 according to the present invention is variously shown in the Figures.

As illustrated in FIG. 1, and as will be apparent once a full understanding of the present application is had, retainers 10 according to the present invention may be advantageously and comfortably secured to the shoulder of a coat, shirt, blouse or similar garment 14 worn by a user 18. The retainer 10 functions to secure the shoulder strap 20 of a bag 22 such as a purse, satchel, or computer carrying case to the user's shoulder, and reliably prevents the strap 20 from sliding off their shoulder. This not only frees the user 18 from worries and constant adjusting of the strap 20 on their shoulder but it also allows the user 18 to free their hands for other uses.

Figure 7:
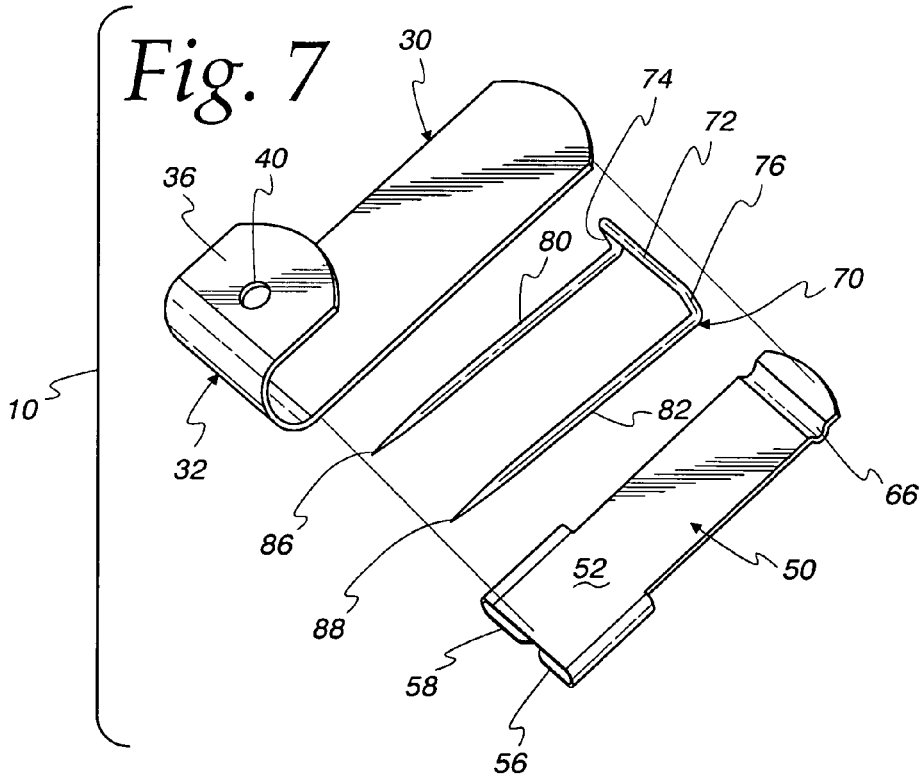
FIG. 7 is an exploded view illustrating the components of the retainer illustrated in the Figures.

The retainer 10 may be advantageously manufactured from a simple three piece structure such as illustrated in FIG. 7. Specifically, the retainer 10 may include a retaining member consisting of a generally flat longitudinal member 30 having a retaining portion 32 on one end. The retaining portion 32 serves to block a bag strap 20 from sliding off of that end of the longitudinal member 30, and in the illustrated particularly advantageous form consists of a U-shaped bend, where one leg 36 of the U-shape extends back in the direction of the longitudinal member 30 (the end of which forms the other leg of the U-shape), and is spaced therefrom a distance which is at least equal to the thickness of the bag strap 20 with which the retainer 10 is expected to be used.

It should be appreciated that the upper side of the retaining member, such as generally seen in FIG. 2, will to some degree or another be visible when worn by a user 18. Thus, it should be appreciated that this surface may be aesthetically designed to provide a pleasing appearance, since the retainer 10 will not only serve a functional purpose but will also provide a visible component of the user's garb, much like jewelry. Therefore, it should be appreciated that the visible surfaces may be suitably decorated to provide a color, texture and design features for that aesthetic appearance. Metals having sufficient strength and durability may thus be suitably used, with the surface finished as desired (including by plating and painting). Suitable gems or other stones may thus also be provided such as illustrated at 40 in FIGS. 2 and 7 (with such location being ideal inasmuch as this surface is not intended to be engaged with a bag strap 20 and therefore will not be as susceptible to having the gem or stone knocked off).

A pin retaining member 50 is suitably secured to one side of the flat longitudinal member 30, as by suitable adhesive, welding, swaging, or other securing methods suitable for the materials used. The pin retaining member 50 may be formed from a T-shaped blank having a longitudinal base 52 with wings 56, 58 extending from opposite sides of one end of the base, where the wings 56, 58 are bent to project inwardly toward one another in a position spaced from and underlying the longitudinal base 52.

The wings 56, 58 may advantageously have flat transverse surfaces 60, 62 facing away from the longitudinal member 30 and lying in substantially the same plane. It should be appreciated that with this structure (see particularly FIGS. 3-4) the two wings 56, 58 will define a flat and relatively wide bottom surface which will rest on the user's shoulder. Thus, the retainer 10 will rest comfortably with the weight of the strap 20 distributed over the relatively large surface area of the surfaces 60, 62 and will not have sharp points digging into the user's shoulder. Further, the retainer 10 will be secured transversely without uncomfortable and disconcerting side-to-side wobble.

On the other end, the pin retaining member 50 includes a transverse ridge or trough 66 which defines a transverse space between the retaining member 50 and the longitudinal member 30 adjacent the end opposite from the retaining portion 32. This trough 50 similarly defines a downwardly facing surface which extends across the substantially the entire width of the retainer 10 so as to additionally prevent side-to-side wobble.

A pin member 70 includes a transverse portion 72 with substantially parallel radial arms 74, 76 extending from opposite ends of the transverse portion 72. Connected to the arms at points spaced radially from the transverse portion 72 are a pair of pin legs 80, 82 which extend substantially parallel to each other toward pointed opposite ends 86, 88.

The pin member transverse portion 72 may advantageously be pivotally trapped in the transverse space defined by the retaining member ridge 66 whereby the entire pin member 70 may be pivoted relative to the longitudinal member 30 around an axis which is a central transverse axis of the trough 66 and/or transverse portion 72.

It should thus be appreciated that, as illustrated in FIG. 4, when the retainer 10 is being secured to a garment 14, the pointed ends 86, 88 of the pin legs 80, 82 may be easily manipulated to stick them through the fabric of the garment 14 and then back out near the other end of the pin legs 80, 82 (see FIG. 6). Pivoting of the pin member 70 away from the longitudinal member 30 permits this to be readily accomplished without interference from the rest of the retainer 10.

Moreover, it should be appreciated that the pin legs 80, 82 are spring bendable toward one another to a released position in which their pointed ends 86, 88 are not between the pin retaining member wings 56, 58 such as illustrated for one leg 80 in phantom in FIG. 5. In a securing position the pin legs 80, 82 are substantially parallel with their pointed ends 86, 88 retained between the pin retaining member wings 56, 58 and the longitudinal member 30 (and longitudinal base 52). Further, the spacing of the wings 56, 58 at their closest points (e.g., at the bottom of FIG. 5) may advantageously be less that the combined diameters of the pin legs 80, 82 so that only one of the pin legs 80, 82 may be moved into or out of the securing position at one time. This helps to ensure that the pin legs 80, 82 do not accidentally move out of the securing position when the retainer 10 is being used.

Still further, it should be appreciated that securing the retainer 10 to a garment shoulder may be readily accomplished by extending the pin legs 80, 82 through the garment 14 in their parallel configuration, and then pivoting the longitudinal member 30 down against the garment shoulder, at which point the pin legs 80, 82 can be individually bent inwardly to pass between the wings 56, 58 and then spring out to their retaining position. In this manner, it should be appreciated that the garment fabric will be bunched together for only a short period while moving the pin legs 80, 82 to the retaining position, and thereafter the garment fabric will lay flat in a relaxed configuration during use of the retainer 10.

It should further be appreciated that the transverse portion 72 of the pin member 70 at the opposite end from the retaining portion 32 will further enhance the securing of the retainer 10 on the garment 14. Specifically, the downward slope of the shoulder is toward the retaining portion 32, and the weight of the shoulder strap 20 tends to pull the retainer 10 in that direction, whereas the transverse portion 72 of the pin member 70 will reliably and with minimal stress to the garment fabric prevent the retainer 10 from pulling off the shoulder in that direction.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A retainer for a shoulder strap of a bag, comprising:

a flat longitudinal member having a retaining portion on one end;

a pin retaining member secured to one side of said flat longitudinal member, said pin retaining member defining a transverse space between the retaining member and the longitudinal member adjacent the longitudinal member other end, and said retaining member including wings spaced from said longitudinal member and projecting inwardly from opposite sides adjacent the longitudinal member one end; and a pin member including a transverse portion pivotally trapped in said transverse space, a first pin leg extending longitudinally from one end of said transverse portion to a pointed end adjacent said longitudinal member one end, and a second pin leg extending longitudinally from the other end of said transverse portion to a pointed end adjacent said longitudinal member one end, whereby in a securing position said pointed ends of said pin legs are between said pin retaining member wings and said longitudinal member.

2. The retainer of claim 1, wherein said first and second pin legs are spring bendable toward one another to a released position in which their pointed ends are not between said pin retaining member wings and said longitudinal member and said pin member transverse portion is pivotable within the transverse space.

3. The retainer of claim 1, further comprising arms extending radially from the ends of the pin member transverse portion and connecting said first and second pin legs to said transverse portion whereby said one end of said first and second pin legs is spaced from said longitudinal member.

4. The retainer of claim 1, wherein said first and second pin legs are substantially parallel to one another in said securing position.

5. The retainer of claim 1, wherein said wings have flat transverse surfaces facing away from said longitudinal member and lying in substantially the same plane.

6. The retainer of claim 1, wherein said first and second pin legs have a diameter X and the wings at their closest are spaced apart less than 2X.

7. The retainer of claim 1, wherein said retaining portion comprise a U-shape on said one end wherein one leg of the U-shape is the one end of the flat longitudinal member and the other leg of the U-shape overlies the longitudinal member one end, with said U-shaped legs being spaced apart a distance which is at least the thickness of the shoulder strap.

8. The retainer of claim 1, wherein said transverse space is defined by a transverse ridge adjacent the other end of the longitudinal member.

9. A retainer for a shoulder strap of a bag, comprising:

a flat longitudinal member having a U-shaped retaining portion on one end with one leg of the U-shape being the one end of the flat longitudinal member and the other leg of the U-shape overlying and spaced from one side of the longitudinal member one end;

a pin retaining member formed from a T-shaped blank having a longitudinal base with wings extending from opposite sides of one end of the base, wherein said wings are bent inwardly to project toward one another in a location spaced from the longitudinal base, and said longitudinal base is secured to the other side of said flat longitudinal member; and a pin member including a transverse portion pivotally secured to the other side of the flat longitudinal member;

a first pin leg extending longitudinally from one end of said transverse portion to a pointed end adjacent said longitudinal member one end, and a second pin leg extending longitudinally from the other end of said transverse portion to a pointed end adjacent said longitudinal member one end, whereby in a securing position said pointed ends of said pin legs are between said pin retaining member wings and said longitudinal member.

10. The retainer of claim 9, wherein said pin retaining member longitudinal base includes a ridge adjacent its other end, and said ridge defines a transverse space against said longitudinal member other side in which said pin member transverse portion is pivotally trapped.

11. The retainer of claim 9, wherein said retaining portion legs are spaced apart a distance which is at least the thickness of a shoulder strap.

12. The retainer of claim 9, wherein said first and second pin legs are spring bendable toward one another to a released position in which their pointed ends are not between said pin retaining member wings and said longitudinal member.

13. The retainer of claim 9, further comprising arms extending radially from the ends of the pin member transverse portion and connecting ends of said first and second pin legs to said transverse portion whereby the connected ends of said first and second pin legs are spaced from said longitudinal member.

14. The retainer of claim 9, wherein said first and second pin legs are substantially parallel to one another in said securing position.

15. A retainer for a shoulder strap of a bag, comprising:

a flat longitudinal member;

a retaining portion on one end of the longitudinal member, said retaining portion being generally U-shaped and extending from one side of the flat longitudinal member with the flat longitudinal member forming one leg of the U-shape;

wings spaced from said longitudinal member and projecting inwardly from opposite sides adjacent the longitudinal member one end; and a pin member including a transverse portion pivotally trapped against the other side of the flat longitudinal member at its other end a first pin leg extending longitudinally from one end of said transverse portion to a pointed end adjacent said longitudinal member one end, and a second pin leg extending longitudinally from the other end of said transverse portion to a pointed end adjacent said longitudinal member one end, whereby in a securing position said pointed ends of said pin legs are between said wings and the other side of said flat longitudinal member.

16. The retainer of claim 15, wherein:

said first and second pin legs are spring bendable toward one another to a released position in which their pointed ends are not between said pin retaining member wings and said longitudinal member; and said pin member transverse portion is pivotable relative to said longitudinal member about an axis substantially transverse to the longitudinal direction of said flat longitudinal member.

17. The retainer of claim 15, further comprising arms extending radially from the ends of the pin member transverse portion and connecting said first and second pin legs to said transverse portion whereby said one end of said first and second pin legs is spaced from said longitudinal member.

18. The retainer of claim 15, wherein said first and second pin legs are substantially parallel to one another in said securing position.

19. The retainer of claim 15, wherein said wings have flat transverse surfaces facing away from said longitudinal member and lying in substantially the same plane.

20. The retainer of claim 15, wherein said first and second pin legs have a diameter X and the wings at their closest are spaced apart less than 2X.

* * * * *